United States Patent [19]

Mitsuhashi et al.

[11] Patent Number: 4,592,987

[45] Date of Patent: Jun. 3, 1986

[54] TONER APPLICATION METHOD AND DEVELOPER COMPOSITION

[75] Inventors: Yasuo Mitsuhashi, Yokohama; Masanori Takenouchi, Urawa; Kenji Okado, Yokohama; Eiichi Imai, Naroshino; Koshi Suematsu, Kawasaki, all of Japan

[73] Assignee: Canon Kabushiki Kaisha, Tokyo, Japan

[21] Appl. No.: 658,787

[22] Filed: Oct. 9, 1984

[30] Foreign Application Priority Data

Oct. 19, 1983 [JP] Japan ..... 58-195602

[51] Int. Cl.[4] ..... G03G 13/08; G03G 13/09

[52] U.S. Cl. ..... 430/102; 430/122; 118/658; 222/403; 222/423; 222/DIG. 1; 427/25; 427/27

[58] Field of Search ..... 430/102, 122; 118/658; 427/25, 27; 222/403, 423, DIG. 1

[56] References Cited

U.S. PATENT DOCUMENTS

| | | | |
|---|---|---|---|
| 4,337,724 | 7/1982 | Hosono et al. | 118/658 X |
| 4,365,586 | 12/1982 | Hosono et al. | 118/658 X |
| 4,385,829 | 5/1983 | Nakahata et al. | 430/122 X |

FOREIGN PATENT DOCUMENTS

| | | | |
|---|---|---|---|
| 56-69669 | 6/1981 | Japan | 430/122 |
| 57-99670 | 6/1982 | Japan | 118/658 |

*Primary Examiner*—Roland E. Martin

*Attorney, Agent, or Firm*—Fitzpatrick, Cella, Harper & Scinto

[57] ABSTRACT

A method for applying a toner comprising: forming, in a container containing a toner and magnetic particles for application of the toner, a magnetic brush of the magnetic particles; circulating the magnetic particles in the container; and forming a thin layer of the toner electrically charged on the toner carrying member; wherein the magnetic particles have a particle size distribution of 30 wt. % or more in the range of 150 to 200 mesh and 5 wt. % or less of under 250 mesh, and the weight ratio of the toner to the magnetic particles is from 5:95 to 50:50 in the region where the magnetic brush is formed.

7 Claims, 2 Drawing Figures

TONER APPLICATION METHOD AND DEVELOPER COMPOSITION

BACKGROUND OF THE INVENTION

This invention relates to a toner application method for developing electrostatic latent images with a toner and a developer composition therefor.

Conventionally, various types of apparatus have been proposed and put into practice as a dry type one-component developer apparatus. However, in any of those types, it has been very difficult to form a thin layer of one-component dry developer, sg that a relatively thick layer of the developer is used. On the other hand, the recent desire for the improved sharpness, resolution or other qualities of developed images has necessitated the achievement of a system for forming a thin layer of one-component dry developer.

A method of forming a thinlayer of one-component dry developer has been proposed in Japanese Laid-Open Patent application No. 43037/1979 and has been put into practical use. However, this method is directed to the formation of a thin layer of a magnetic developer, not of a non-magnetic developer. The particles of a magnetic developer must each contain a magnetic material in a large proportion to gain a magnetic property. This is disadvantageous since it results in poor image fixing characteristic when the developed image is heat-fixed on a recording paper to be transfer-printed. Further, because the magnetic material is generally black or dark-brown in color, it is difficult to obtain a clear color image by using a magnetic toner. As employed herein the phrase "in the range of 150 to 250 mesh" refers to a mass of magnetic particles passing a sieve of 150 mesh and not passing a sieve of 200 mesh; "100 to 150 mesh " and "200 to 250 mesh" refers to particles passing a sieve of 100 mesh or 200 mesh, but not 150 mesh or 250 mesh, respectively; "under 250 mesh" means a mass of particles passing through a sieve of 250 mesh; and "over 100 mesh" means a mass of particles not passing a sieve of 100 mesh.

SUMMARY OF THE INVENTION

A principal object of the present invention is to provide a novel toner application method for obviating the above mentioned difficulties.

A further object of the present invention is to prevent a toner from leaking out of a developing apparatus.

These and other objects of the present invention are accomplished by a method for applying a toner comprising:

forming, in a container containing a toner and magnetic particles for application of the toner, a magnetic brush of the magnetic particles;

circulating the magnetic particles in the container, and forming a thin layer of the toner electrically charged on the toner carrying member; wherein the magnetic particles have a particle size distribution of 30 wt. % or more in the range of 150 to 200 mesh and 5 wt. % or less of under 250 mesh, and the weight ratio of the toner to the magnetic particles is from 5:95 to 50:50 in the region where said magnetic brush is formed.

According to another aspect of the present invention, there is provided a developer composition comprising a toner and magnetic particles, wherein the magnetic particles have a particle size distribution of 30 wt. % or more in the range of 150 to 200 mesh and 5 wt. % or less of under 250 mesh, and the weight ratio of the toner to the magnetic particles is from 5:95 to 50:50.

DETAILED DESCRIPTION OF THE INVENTION

In practicing the present invention, there is used an image bearing member, which may be a member in the form of a drum or a belt having a layer of a photosensitive material and a layer of an insulating material. A rotating or circulating toner carrying member is further used. The toner carrying member may be in the form of a cylindrical sleeve or an endless belt made of a non-magnetic metal such as aluminum, copper, stainless steel or brass, or a synthetic resin. The surface of the toner carrying member may be roughened or provided with unevenness pattern in order to improve the toner conveying performance or to enhance the triboelectrification characteristic. Inside the toner carrying member or on the opposite side of the toner carrying member with respect to the image bearing member, a magnet for forming a magnetic brush may be disposed. The magnet may be in the form of a roller or cylinder wherein a plurality of magnetic poles of the same or opposite polarities are formed along the extending direction of the roller or cylinder, or an assembly of plural bar-shaped magnets affixed onto a fixed supporting member. A regulating member may be provided as desired at the outlet of a developer container. The regulating member may be a blade or plate or a wall made of a magnetic material such as iron or a nonmagnetic material such as aluminum, copper or a resin.

The present invention will be explained hereinbelow by referring to the accompanying drawings.

Figure 1:
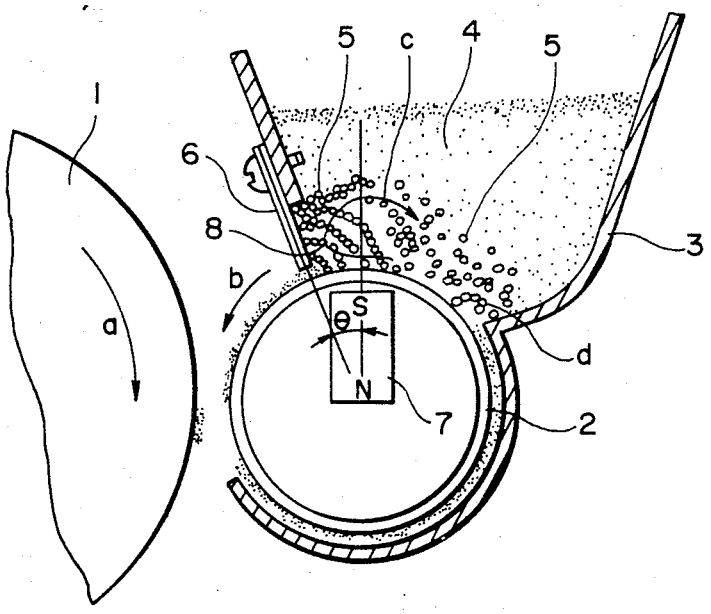
FIG. 1 shows a partial and schematic sectional view illustrating a developing apparatus for use in practicing the toner application method of the present invention.

FIG. 1 shows the cross-section of a developing apparatus to illustrate the principle of the development operation using the toner application method according to the present invention. The apparatus comprises an electrophotographic photosensitive drum 1 as a latent image bearing member which bears a latent image formed by an unshown latent image forming means. It is rotatable in the direction shown by arrow a passing through a developing station, where a non-magnetic sleeve 2, as a toner carrier for carrying a toner, is faced to the image bearing member with a predetermined gap or clearance. The sleeve 2 rotates in the direction shown by arrow b. Above the sleeve 2 is provided a container 3, made of a non-magnetic material such as resin or aluminum, for containing a mixture of a toner 4 and magnetic particles 5. The container 3 has, at its downstream side with respect to movement of the sleeve 2, a magnetic blade 6 screwed to the container 3 as a means for regulating the supply of the toner to the developing station.

Across the sleeve 2 with respect to the magnetic blade 6 and inside the sleeve 2, a magnet 7 is provided. The position of the magnet 7 is determined in connection with the position of a magnetic pole S thereof and the position of the magnetic blade 6, and practically, the pole S is preferably positioned slightly upstream of the position of the magnetic blade 6. This arrangement provides better prevention of magnetic particle leakage through the clearance between the magnetic blade 6 and the sleeve 2 surface and better application of the toner onto the sleeve 2 surface.

In the above arrangement, the magnetic particles within the container 3 forms a magnetic brush by the magnetic field formed between the magnetic pole S of the magnet 7 and the magnetic blade 6. Upon rotation of the sleeve 2, magnetic particles and toner are mixed and stirred, while the magnetic brush 8 is kept formed. In the neighborhood of the magnetic blade 6, the mixture of toner and magnetic particles except for the portion of the toner passing through the magnetic blade 6 carried on the sleeve 2 is stopped by the magnetic blade 6 so that the mixture moves upwardly and circulates as shown by arrow c.

The toner is charged triboelectrically by the friction with the magnetic particles. The charged toner is uniformly applied onto the sleeve 2 by the image force as a thin layer of non-magnetic developer and conveyed to approach the photosensitive drum 1.

The magnetic particles constituting the magnetic brush 8 is prevented from going out through the clearance between the magnetic blade and the sleeve 2, by setting the confining force of the magnetic field by the magnet 7 to be larger than conveying force caused by the friction between the sleeve 2 and the magnetic particles. And, when the magnetic brush-forming region contains toner, the content of the toner in this brush region is maintained constant by the rotation of the sleeve 2, so that the consumption of the developer is automatically compensated by the non-magnetic developer supplied to the magnetic brush 8. Thus, a constant amount of the non-magnetic developer is applied or coated on the sleeve 2.

As will be apparent from the foregoing explanation, the magnetic particles are particularly important as a principal component of the present invention. The magnetic particles as a carrier material in the conventional two component developer wherein the magnetic particles are used in a much larger proportion than a toner, are required as a principal function to triboelectrically charge the toner and control the amount of the charge. On the contrary, the magnetic particles of the present invention are required to fulfil functions of forming a magnetic brush in a region where the toner is present in a much larger proportion than in the two component developer, applying the toner on the toner carrying member and regulating the amount thereof. The magnetic particles are further required to fulfil a function of supplying the toner while circulating. Furthermore, it is not desirable that the magnetic particles pass by the regulating member. In order to fulfil these functions, the magnetic particles must show an appropriate circulatability while being confined by a confining force exerted by a magnetic field and form a magnetic brush having appropriate hardness and density so as to allow uniform application of the toner. A relatively sparse magnetic brush is liable to result in streaks of excessive and sparse toner on the toner carrying member due to insufficient regulation. On the contrary, a dense magnetic brush is liable to give an extremely thin coating layer on the toner carrying member. Either case is not desirable. Further, when the magnetic particles show an excessive circulatability, too thick a coating layer is formed to cause fog on the resultant image. On the other hand, when they show insufficient circulatability, several defects are encountered such as occurrence of ghost.

As a result of our studies in various respects for satisfying the above mentioned variety of functions to be fulfiled by the magnetic particles and toner for the purpose of the present invention, we have obtained a knowledge that it is extremely important to appropriately set the particle size distribution of the magnetic particles for application of the toner and the weight ratio of the toner to the magnetic partices in the magnetic brush forming region.

As has been briefly described hereinbelow, it is essential that the magnetic particles have a particle size distribution of 30 wt. % or more in the range of 150 to 200 mesh and 5 wt. % or less of under 250 mesh; preferably a distribution of 30 wt. % or les of over 100 mesh, 50 wt. % or more of 150 to 200 mesh, and 4 wt. % or less of under 250 mesh; particularly preferably a distribution of 10 wt. % or less of over 100 mesh, 60 wt. % or more of 150 to 200 mesh and 3 wt. % or less of under 250 mesh; and the weight ratio of the toner to the magnetic particles in the magnetic brush forming region is from 5:95 to 50:50, preferably from 6:94 to 20:80, and particularly preferably from 7:93 to 15:85. Herein, the magnetic brush forming region is defined as a region containing and enveloping the magnetic particles which are circulating under the constraint of the magnetic field in the container.

In the particle size distribution of the magnetic particles, if the particles of 150 to 200 mesh are below 30 wt. % and the particles of under 250 mesh exceed 5 wt. %, leakage of the magnetic particles occurs or the quality of image deteriorates.

Further, if the weight ratio of the toner to the magnetic particles is below 5:95, the image density lowers and, if above 50:50, fogging occurs in the resultant image.

In the present invention, "150 to 200 mesh" refers to a mass of magnetic particles passing a sieve of 150 mesh and not passing a sieve of 200 mesh, "under 250 mesh" a mass of particles passing through a sieve of 250 mesh; and "over 100 mesh" a mass of particles not passing a sieve of 100 mesh. Herein, the mesh size is along the definition of Japanese Industrial Standards (JIS) Z-8801.

Further, the volume average particle size of the toner should preferably be within the range of 5 to 20 microns, particularly preferably 10 to 17 microns, as a value measured by means of a Coulter counter using an aperture of 100 microns.

As described before, the magnetic particles of the present invention are required to fulfil essential functions of forming a magnetic brush in a system or container where the toner is present generally in a larger proportion than the magnetic particles and of applying the toner onto the toner carring member or onto the image forming member where the toner is directly applied to the image bearing member, rather than only to control the triboelectric charge of the toner. In order to meet these requirements, the particle size distribution of the magnetic particles and the mixing ratio between the toner and the magnetic particles in the magnetic brush forming region is important. In the conventional two-component developer comprising a carrier and a toner, the principal function or object of the carrier is to control the charge of the toner and, when a carrier comprising magnetic particles having a similar particle size distribution as that of the magnetic particles of the present invention, the proper mixing ratio of the toner to the carrier in the developer is within a range of the order of 1:99 to 3:97 on a weight basis. This is substantially lower than that in the developer composition of the present invention. Further, the developer composition of the present invention forms a substantially pure toner layer on a mixture of the toner and the magnetic particles during the developing operation and is thus different from the conventional two component developer composition containing a carrier in respect of the form during development.

The magnetic particles to be used in the present invention may, for example, be surfaceoxidized or non-oxidized particles of a metal such as iron, nickel, cobalt, manganese, chromium or a rare earth metal, or an alloy of these, or particles of an oxide of these metals. No particular restriction is posed on the processes for production of the magnetic particles. The surface of these magnetic particles may be treated or coated with a resin or other appropriate treating agents.

On the other hand, the toner to be used in the present invention may comprise a binder resin of, for example, homopolymers of sytrene and derivatives thereof such as polystyrene, poly-p-chlorostyrene, polyvinyltoluene, and the like; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-isoprene copolymer, styrene-acrylonitrile-indene copolymer, styrene-maleic acid copolymer, styrene-maleic acid ester copolymer, and the like; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenol resins, aliphatic or alycyclic hydrocarbon resins, aromatic petroleum resin, chlorinated paraffin, paraffin wax, etc. These binder resins may be used either singly or as a mixture.

As the colorant to be used in the toner, pigments or dyes known in the art such as carbon black, iron black, Phthalocyanine Blue, ultramarine, quinacridone, or Benzidine Yellow may be employed.

It is also possible to add, as a charge controlling agent, an amino compound, a quarternary ammonium compound or an organic dye, particularly a basic dye or its salt such as benzyldimethyl-hexadecyl ammonium chloride, decyl-trimethylammonium chloride, nigrosin base, nigrosine hydrochloride, Safranine γ, or Crystal Violet, a metal-containing dye, salicylic acid metal-containing compound, etc. Further, it is possible to add magnetic powder within such an extent that the effect of the invention is not hindered.

The above mentioned composition of the toner may be applicable to an ordinary developer obtained through the mixing-crushing method, or to either one or both of the wall material and core material of a microcapsule toner.

The toner application method of the present invention is preferably applied to a developing method wherein the thus formed layer of toner is caused to jump onto an image bearing member to develop the image on the image bearing member. In this case, the image bearing member is disposed to face the toner carrying member with a gap or clearance therebetween wider than the thickness of the applied toner layer formed on the toner carrying member.

The present invention will be described in further detail by referring to actual examples of practice. In the examples, parts are by weight.

EXAMPLE 1

Figure 2:
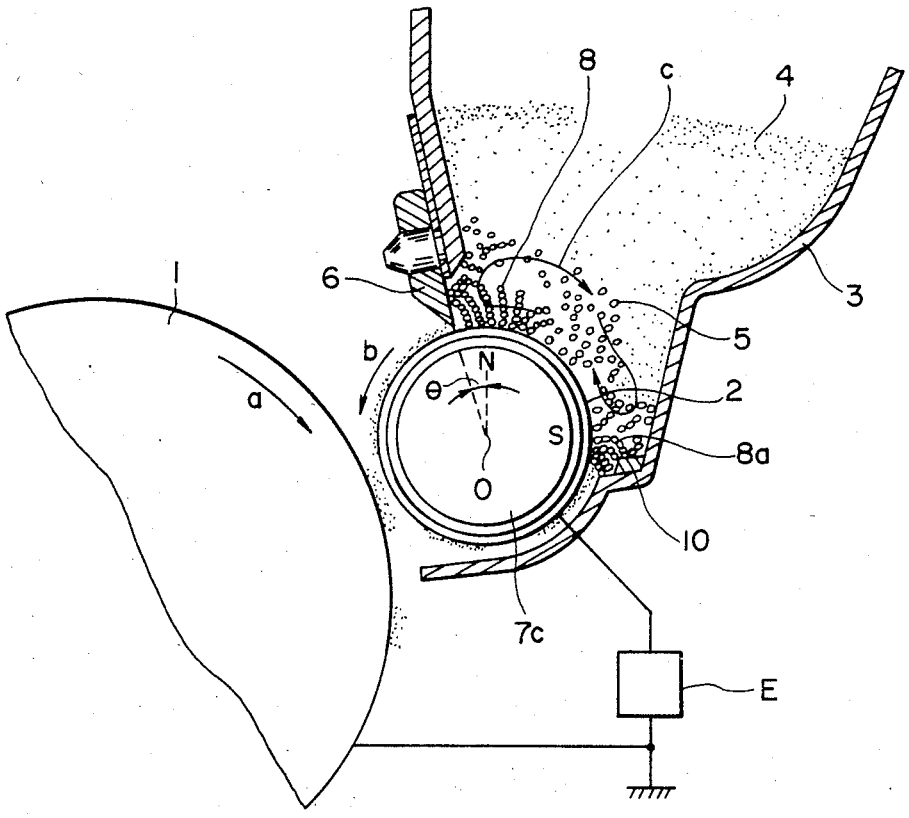
FIG. 2 shows a partial and schematic sectional view illustrating a developing apparatus used in actual examples of practice of the toner application method of the present invention.

The method of the present invention was practiced by using a developing apparatus as shown in FIG. 2. In FIG. 2, the same reference numerals denote substantially the same members as illustrated in FIG. 1.

In the apparatus shown in FIG. 2, a photosensitive drum 1 rotated at a peripheral speed of 60 mm/sec in the direction of arrow a. A sleeve 2 made of stainless steel (SUS 304) having an outer diameter of 32 mm and a thickness of 0.8 mm rotated in the direction of arrow b at a peripheral speed of 66 mm/sec. The surface of the sleeve 2 had been subjected to irregular shape sand blasting with alundum abrasive particles of 600 mesh pass and caused to have a roughness in the circumferential direction (Rz) of 0.8 micron. Inside the sleeve 2 was disposed a magnet 7*c* of a sintered ferrite type of which the first N pole was deviated toward inside of the container 3 by an angle ($\theta$ in the Figure) of 30° with respect to the line converting the tip of the magnetic blade 6 and the center of the sleeve 2.

The magnetic blade 6 was made of iron and the surface thereof was plated with nickel for prevention of staining. This blade 6 was disposed with a gap of 200 microns from the surface of the sleeve 2.

As the magnetic particles 5 were used irregular shape of iron particles having a particle size distribution of 3 wt. % of over 100 mesh, 14 wt. % of 100 to 150 mesh, 70 wt. % of 150 to 250 mesh, 12.3 wt. % of 200 to 250 mesh, and 0.7 wt. % of under 250 mesh.

The toner 4 was provided as a cyan-colored negatively chargeable powder of 13 microns in average particle size obtained by mixing 100 parts of a polyester resin (M.W.: about 40,000, Softening point: 150° C.), 10 parts of a copper phthalocyanine pigment (C.I. Pigment Blue 15) and 5 parts of a negative charge controlling agent (alkylsalicylic acid metal complex), to which 0.5% of silica was externally added and mixed. The toner in an amount of 5 parts was well mixed with 50 parts of the magnetic particles and the mixture was charged into the container 3. Above the mixture was further added 200 parts of the toner. The circulation of the mixture of the toner and the magnetic particles in the container 3 was observed especially when the amount of the toner decreased.

In the above arrangement of developing apparatus, a layer of only the toner with about 80 microns-thickness was formed along with the rotation of the sleeve. The toner layer was subjected to the measurement of charged level by the blow-off method and found to be uniformly charged at the level of $-8.2$ μc/g.

On a photosensitive drum 1 facing the sleeve with a gap of 300 microns was formed a charge pattern with a dark part of $+600$ V and a light part of $+150$ V. To the sleeve was applied an alternating voltage in a frequency of 800 Hz and with a peak-to-peak value of 1.4 kV and a central value of $+300$ V, whereby clear blue images of high quality were obtained without development irregularity, ghost image or fogging.

With respect to the mixture in the container 3, the magnetic particles were substantially not dissipated but the toner was selectively consumed. The developing function was stable without charge until most of the toner was consumed. Furthermore, the composition of the initially charged mixture (i.e. 5 parts of the toner with respect to 50 parts of the magnetic particles) was substantially maintained in the magnetic brush forming region during the continuous operation. This fact was confirmed by once stopping the operation and slanting the container to spill the toner above the brush forming region. After the toner was consumed, the development apparatus was taken out from the entire system and the lower part of the sleeve 2 was inspected, whereby no leakage of the magnetic particles nor even of the toner was observed.

EXAMPLE 2

The procedure of Example 1 was repeated with some modifications.

The gap between the blade 6 and the sleeve 2 was set at 100 microns. As the magnetic particles 5 were used iron powder treated with a silicone resin (M.W.: about 10,000) and having a particle size distribution of 8.0 wt. % of over 100 mesh, 19.2 wt. % of 100 to 150 mesh, 60.0 wt. % of 150 to 200 mesh, 11.6 wt. % of 200 to 250 mesh and 1.2 wt. % of under 250 mesh. The toner 4 comprised powder (volume-average particle size of 14 microns) of a mixture of 100 parts of a styrene-acrylic resin (copolymerization ratio: 70:30, M.W.: about 100,000), 10 parts of an azo pigment (C.I. Pigment Red 57) and 5 parts of an aminoacrylic resin (M.W.: about 20,000, Softening point: 100° C.), and 0.5 part of colloidal silica externally added and mixed therewith. Eight parts of the toner and 50 parts of the magnetic particles were, after sufficient mixing, charged to the container 3, in which 200 parts of the toner was further charged. An organic photoconductor was used to form the photosensitive drum 1.

With the above modifications, the procedure of Example 1 was repeated, whereby the magnetic particles circulated properly to form a thin layer of only the toner on the surface of sleeve 2. By using this thin layer of toner, an electrostatic imge on the photosensitive drum was developed, whereby an extremely good red developed image was obtained. The above developing operation was stable without change until most of the toner was consumed, with no occurrence of leakage of toner or magnetic particles to below the sleeve 2.

COMPARATIVE EXAMPLE 1

The procedure of Example 1 was repeated except that as the magnetic particles was used iron powder of irregular shape having a particle size distribution of 0.5 wt. % of over 100 mesh, 5.5 wt. % of 100 to 150 mesh, 55.4 wt. % of 100 to 150 mesh, 28.4 wt. % of 200 to 250 mesh, and 10.2 wt. % of under 250 mesh.

As the result of the copying test, good images were obtained at the initial stage but, after a long period of successive copying test, leakage of the magnetic particles out of the container occurred extensively.

COMPARATIVE EXAMPLE 2

Example 1 was repeated except that as the magnetic particles was used iron powder of irregular shape having a particle size distribution of 22 wt. % of over 100 mesh, 47.1 wt. % of 100 to 150 mesh, 25.4 wt. % of 150 to 200 mesh, 5.2 wt. % of 200 to 250 mesh and substantially zero of under 250 mesh.

As the result of the copying test, good images were obtained at the initial stage but, after a long period of successive copying test, fog occurred in the resultant images. The fog was extensive especially in the environment of a low humidity.

COMPARATIVE EXAMPLE 3

The copying test of Example 1 was similarly repeated except that the weight ratio of the toner to the magnetic particles in the magnetic brush forming region was changed to 2:98 by changing the composition of the initially charged mixture, whereby only images of a low image density were obtained.

COMPARATIVE EXAMPLE 4

The copying test of Example 1 was similarly conducted except that the weight ratio of the toner to the magnetic particles was changed to 60:40 by changing the composition of the initially charged mixture, whereby the resultant images had a high image density but were accompanied with fog.

What is claimed is:

1. A method for developing a latent electrostatic image comprising: forming, in a container containing a non-magnetic toner and magnetic particles for application of the toner, a magnetic brush of the magnetic particles;

circulating the magnetic particles in the container; and forming a thin layer of the toner triboelectrically charged on a toner carrying member inside of which a magnet for forming said magnetic brush is disposed; wherein the magnetic particles have a particle size distreibution of 30 wt. % or more in the range of 150 to 200 mesh and 5 wt. % or less of under 250 mesh, and the weight ratio of the toner to the magnetic particles is from 5:95 to 50:50 in the region where said magnetic brush is formed, and applying said thin layer of toner to develop said electrostatic image.

2. The method according to claim 1, wherein the magnetic particles have a particle size distribution of 30 wt. % or less of over 100 mesh, 60 wt. % or more of 150 to 200 mesh, and 3 wt. % or less of under 250 mesh.

3. the method according to claim 2, wherein the magnetic particles have a particle size distribution of 10 wt. % or less of over 100 mesh, 60 wt. % or more of 150 to 200 mesh, and 3 wt. % or less of under 250 mesh.

4. The method according to claim 1, wherein the weight ratio of the toner to the magnetic particles is from 6:94 to 20:80 in the magnetic brush forming region.

5. The method according to claim 4, wherein the weight ratio of the toner to the magnetic particles is from 7:93 to 15:85 in the magnetic brush forming region.

6. The method according to claim 1, wherein the magnetic particles are surface-oxidized or non-oxidized particles of a metal selected from the group consisting of iron, nickel, cobalt, manganese, chromium and rare earth metals, or an alloy of these metals, or particles of an oxide of these metals.

7. The method according to claim 1, wherein the toner is chromatically colored and substantially free of a magnetic material.

* * * * *

UNITED STATES PATENT AND TRADEMARK OFFICE

CERTIFICATE OF CORRECTION

PATENT NO. : 4,592,987

DATED : June 3, 1986

INVENTOR(S) : YASUO MITSUHASHI, ET AL.

It is certified that error appears in the above-identified patent and that said Letters Patent is hereby corrected as shown below:

COLUMN 6

Line 63, "sleeve" should read --sleeve 2--.

COLUMN 8

Line 36, "distreibution" should read --distribution--.

Signed and Sealed this

Thirty-first Day of March, 1987

*Attest:*

DONALD J. QUIGG

*Attesting Officer*

*Commissioner of Patents and Trademarks*